US005232854A

United States Patent [19]

Monticello

[11] Patent Number: 5,232,854

[45] Date of Patent: Aug. 3, 1993

[54] MULTISTAGE SYSTEM FOR DEEP DESULFURIZATION OF FOSSIL FUELS

[75] Inventor: Daniel J. Monticello, Elkhart, Ind.

[73] Assignee: Energy BioSystems Corporation, The Woodlands, Tex.

[21] Appl. No.: 669,914

[22] Filed: Mar. 15, 1991

[51] Int. Cl.[5] ..... C10G 32/00; C12S 1/00; B66D 1/20; C10L 5/00

[52] U.S. Cl. ..... 435/282; 435/262; 435/281; 44/385; 252/312

[58] Field of Search ..... 435/262, 281, 282; 44/585; 252/312

[56] References Cited

U.S. PATENT DOCUMENTS

| | | |
|---|---|---|
| 2,521,761 | 9/1950 | Strawinski . |
| 2,574,070 | 11/1951 | Strawinski . |
| 2,641,564 | 6/1953 | Zobell . |
| 2,975,103 | 3/1961 | Kirshenbaum . |
| 3,069,325 | 12/1962 | Hitzman . |
| 3,305,353 | 2/1967 | Duncan et al. . |
| 4,206,288 | 6/1980 | Detz et al. . |
| 4,283,270 | 8/1981 | McHale . |
| 4,562,156 | 12/1985 | Isbister et al. . |
| 4,632,906 | 12/1986 | Kopacz . |
| 4,659,670 | 4/1987 | Stevens et al. . |
| 4,703,010 | 10/1987 | Yunker et al. . |
| 4,808,535 | 2/1989 | Isbister . |
| 4,851,350 | 1/1989 | Stevens et al. . |
| 4,861,723 | 8/1989 | Madgavkar . |
| 4,954,229 | 9/1990 | Kim et al. . |
| 5,002,888 | 3/1991 | Kilbane . |
| 5,104,801 | 4/1992 | Kilbane ..... 435/282 |

OTHER PUBLICATIONS

Gary, J. H. and G. E. Handwerk (1975), *Petroleim Refining Technology and Economics*, Marcel Dekker, Inc., N.Y., pp. 114–120.

Speight, J. G. (1981) *The Desulfurization of Heavy Oils and Residue* Marcel Dekker, Inc., N.Y., pp. 119–127.

Gundlach, E. R. et al., (1983) *Science* 221:122–129.

Hartdegan, F. J. et al., (May 1984) *Chem. Eng. Progress*, pp. 63–67.

Monticello, D. J. and W. R. Finnerty (1985), *Ann. Rev. Microiol.* 39:371–389.

Shih, S. S. et al (Nov. 12, 1990) Deep Desulfurization of Distillate Components, Chicago Ann. Mtg., Amer. Inst. Chem. Eng. Abstract No. 264B (complete text of monograph available from A.I.Ch.E. upon request).

Kilbane, J. J. (1990), *Resour. Cons. Recycl.* 3:69–79.

Monticello, D. J. and J. J. Kilbane (Dec. 3–5, 1990), Practical Considerations in Biodesulfurization of Petroleum (monograph), *IGT's 3d Intl. Symp. on Gas, Oil, Coal, and Env. Biotechnol.*, New Orleans, La.

(List continued on next page.)

*Primary Examiner*—Michael G. Wityshyn
*Assistant Examiner*—Timothy J. Reardon
*Attorney, Agent, or Firm*—Hamilton, Brook, Smith & Reynolds

[57] ABSTRACT

A method of deeply desulfurizing a fossil fuel which contains a variety of organic sulfur compounds, some of which are labile to hydrodesulfurization (HDS) and some of which are refractory to HDS, comprising the steps of (a) subjecting the fossil fuel to HDS or a similar method of desulfurizing labile organic sulfur compounds, and (b) subjecting the fossil fuel to biocatalytic desulfurization (BDS) using a biocatalyst which is capable of selectively liberating sulfur from HDS-refractory organic sulfur compounds. In this manner, a fossil fuel is produced which does not generate sufficient levels of hazardous, sulfur-containing combustion products that it requires post-combustion desulfurization when it is burned. Moreover, the deeply desulfurized fossil fuel can be produced using only a mild HDS treatment, rather than requiring conditions which may be severe enough to be detrimental to the fuel value of the desired product. The biocatalyst employed in the BDS stage of the instant invention is capable of catalyzing the sulfur-specific, oxidative cleavage of organic carbon-sulfur bonds in sulfur-bearing aromatic heterocyclic molecules such as dibenzothiophene. A particularly preferred biocatalyst is a culture of *Rhodococcus rhodocrous* bacteria, ATCC No. 53968.

9 Claims, 3 Drawing Sheets

OTHER PUBLICATIONS

Lee et al, "Sulfur Removal from Coal through Multiphase Media Containing Biocatalysts", J. Chem. Tech. Biotechnol. (1990), vol. 48, pp. 71–79.

Kilbane, J. "Desulfurization of Coal: the Microbial Solution". Trends Biotechnology (Apr., 1989) vol. 7, No. 4 pp. 97–101.

Kargi et al. "Microbial Oxidation of Dibenzothiophene . . . " Biotechnology and Bioengineering (1984), vol. 26, pp. 687–690.

Isbister et al. "Microbial Desulfurization of Coal" Internat. Conf. on Processing and Utilization of High Sulfur Coals Oct. 13–17, 1985.

Kilbane, J. "Biodesulfurization: Future Prospects in Coal Cleaning", presented at Pittsburgh Coal Conf. Sep. 10–14, 1990.

Kilbane, J. "Biodesulfurization of Coal" presented at IGT Symposium Biotech., in New Orleans dec. 5–7, 1988.

MULTISTAGE SYSTEM FOR DEEP DESULFURIZATION OF FOSSIL FUELS

BACKGROUND

Sulfur is an objectionable element which is nearly ubiquitous in fossil fuels. The presence of sulfur has been correlated with corrosion of pipeline, pumping, and refining equipment, and with premature breakdown of combustion engines. Sulfur also contaminates or poisons many catalysts which are used in the refining and combustion of fossil fuels. Moreover, the atmospheric emission of sulfur combustion products such as sulfur dioxide leads to the form of acid deposition known as acid rain. Acid rain has lasting deleterious effects on aquatic and forest ecosystems, as well as on agricultural areas located downwind of combustion facilities. Monticello, D. J. and W. R. Finnerty, (1985) *Ann. Rev. Microbiol.* 39:371-389. Regulations such as the Clean Air Act of 1964 require the removal of sulfur, either pre- or post-combustion, from virtually all fossil fuels. Conformity with such legislation has become increasingly problematic due to both the rising need to utilize lower-grade, higher-sulfur fossil fuels as clean-burning, low-sulfur petroleum reserves become depleted, and as the progressive reductions in sulfur emissions required by regulatory authorities become more stringent. Monticello, D. J. and J. J. Kilbane, "Practical Considerations in Biodesulfurization of Petroleum", *IGT's 3d Intl. Symp. on Gas, Oil, Coal, and Env. Biotech.*, (Dec. 3-5, 1990) New Orleans, La.

There are several well-known physicochemical methods for depleting the sulfur content of fossil fuels prior to combustion. One widely-used technique is hydro-desulfurization, or HDS. In HDS, the fossil fuel is contacted with hydrogen gas at elevated temperature and pressure, in the presence of a catalyst. The removal of organic sulfur is accomplished by reductive conversion of sulfur compounds to $H_2S$, a corrosive gaseous product which is removed by stripping. As with other desulfurization techniques, HDS is not equally effective in removing all forms of sulfur found in fossil fuels. Gary, J. H. and G. E. Handwerk, (1975) *Petroleum Refining: Technology and Economics,* Marcel Dekker, Inc., New York, pp. 114-120.

For example, HDS is not particularly effective for the desulfurization of coal, wherein inorganic sulfur, especially pyritic sulfur, can constitute 50% or more of the total sulfur content of the fossil fuel the remainder being various forms of organic sulfur. Pyritic sulfur is not efficaciously removed from fossil fuel by HDS. Thus, only a fraction of the total sulfur content of coal may be susceptible to removal by physiochemical methods such as HDS. The total sulfur content of coal can typically be close to about 10 wt % or it can be as low as about 0.2 wt %, depending on the geographic location of the coal source.

HDS is relatively more suitable for desulfurizing liquid petroleum, such as crude oil or fractions thereof, as close to 100% of the sulfur content these fossil fuels can be organic sulfur. Crude oils can typically range from close to about 5 wt % down to about 0.1 wt % organic sulfur; crude oils obtained from the Persian Gulf area and from Venezuela can be particularly high in sulfur content. Monticellow, D. J. and J. J. Kilbane, "Practical Considerations in Biodesulfurization of Petroleum", *IGT's 3d Intl. Symp, on Gas, Oil, Coal, and Env. Biotech.*, (Dec. 3-5, 1990) New Orleans, La., and Monticello, D. J. and W. R. Finnerty, (1985) *Ann. Rev. Microbiol.* 39:371-389.

Organic sulfur in both coal and liquid petroleum fossil fuels is present in a myriad of compounds, some of which are labile and can be readily divested of sulfur by HDS, and some of which are refractory and do not yield to HDS treatment. Shih, S. S. et al., (1990) AIChE Abstract No. 264B (complete text available upon request from the American Institute of Chemical Engineers); hereinafter, Shih et al. Thus, even HDS-treated fossil fuels must be post-combustively desulfurized using an apparatus such as a flue scrubber. Flue scrubbers are expensive to install and difficult to maintain, especially for small combustion facilities. Moreover, of the sulfur-generated problems noted above, the use of flue scrubbers in conjunction with HDS is directed to addressing environmental acid deposition, rather than other sulfur-associated problems, such as corrosion of machinery and poisoning of catalysts.

The classes of organic molecules which are often labile to HDS treatment include mercaptans, thioethers, and disulfides. Aromatic sulfur-bearing heterocycles (i.e., aromatic molecules bearing one or more non-carbon atoms on the aromatic ring itself) comprise the major class of organic sulfur molecules retractory to HDS or similar physicochemical treatments. These refractory molecules typically require desulfurization conditions harsh enough to degrade valuable hydrocarbons in the fossil fuel. Shih et al.

These significant drawbacks to HDS are typical of physicochemical desulfurization methods generally. As a result, there has been considerable interest in the industry for at least the past 20-30 years in developing commercially viable techniques of microbial desulfurization, or MDS. MDS is generally described as the harnessing of metabolic processes of suitable bacteria to the desulfurization of fossil fuels. MDS typically involves mild (e.g., physiological) conditions, and does not involve the extremes of temperature and pressure required for HDS. Several species of chemolithotrophic bacteria have been investigated in connection with MDS development, due to their abilities to metabolize the forms of sulfur generally found in fossil fuels. For example, species such as *Thiobacillus ferrooxidans* are capable of extracting energy from the conversion of pyritic (inorganic) sulfur to water-soluble sulfate. Such bacteria are envisioned as being well-suited to the desulfurization of coal. Other species, including *Pseudomonas putida,* are capable of catabolizing the breakdown of organic sulfur molecules, including to some extent sulfur-bearing heterocycles, into water-soluble sulfur products. However, this catabolic desulfurization is merely incident to the utilization of the hydrocarbon portion of these molecules as a carbon source: valuable combustible hydrocarbons are lost. Moreover, MDS proceeds most readily on the same classes of organic sulfur compounds as are most susceptible to HDS treatment. Thus, although MDS does not involve exposing the fossil fuels to the extreme conditions encountered in HDS, a significant amount of the fuel value of the coal or liquid petroleum can be lost, and the treated fuel often still requires post-combustion desulfurization. Monticello, D. J. and W. R. Finnerty, (1985) *Ann. Rev. Microbiol.* 39:371-389, and Hartdegan, F. J. et al., (May 1984) *Chem. Eng. Progress* 63-67.

A need remains to develop more effective methods for pre-combustion desulfurization. This need grows progressively more urgent as lower-grade, higher-sulfur fossil fuels are increasingly used, while concurrently the sulfur emissions standards set by regulatory authorities become ever more stringent.

SUMMARY OF THE INVENTION

This invention relates to a method for the deep desulfurization of a fossil fuel, comprising the steps of: (a) subjecting the fossil fuel to hydrodesulfurization (HDS), whereby the fossil fuel is depleted of forms of sulfur susceptible to removal by HDS but is not depleted of forms of sulfur refractory to this process; (b) contacting the fossil fuel with an effective amount of a biocatalyst capable of depleting the fossil fuel of forms of organic sulfur which are refractory to HDS; (c) incubating the fossil fuel with the biocatalyst under conditions sufficient for the removal of a substantial amount of the HDS-refractory sulfur forms; and (d) separating the products of the incubation of (c), the products being: (i) fossil fuel depleted of HDS-refractory forms of sulfur, and (ii) the biocatalyst and the sulfur-containing reaction products of the incubation of (c).

The invention described herein directly addresses the problems posed by the limitations of current techniques for desulfurizing fossil fuels. The instant invention provides for the pre-combustion removal of a significantly greater proportion of most forms of sulfur found in fossil fuels than can be removed with existing pre-combustion techniques without requiring the use of severe, deleterious physical conditions, thereby eliminating the need for post-combustion desulfurization with its attendant problems. The instant invention is suited to the desulfurization of both solid (e.g., coal) and liquid (e.g., petroleum, such as crude oil or a fraction thereof) fossil fuels; however, it offers a greater advantage over existing techniques of desulfurization in the area of liquid fossil fuels. In preferred embodiments of the present invention, the agent of (b) comprises a microbial biocatalyst which is capable of liberating sulfur in the form of inorganic sulfate from sulfur-bearing heterocyclic aromatic molecules by sulfur-specific oxidative cleavage. A highly preferred biocatalyst comprises a culture of *Rhodococcus rhodocrous* bacteria, ATCC No. 53968. The method described herein provides for the synergistic removal of a significantly greater proportion of the total sulfur from a fossil fuel than could be accomplished using current techniques. This unique combinative or multistage system allows for the production of a deeply-desulfurized fossil fuel having sufficiently low residual sulfur levels that it can be burned without post-combustion desulfurization.

A further advantage to the instant invention is its flexibility. The stages of the present invention can be carried out in a manner most advantageous to the needs of a particular fossil fuel refining or processing facility. Depending on the layout of the facility, available unit operations, products generated, and source of the fossil fuel (among other considerations), it may be advantageous to first subject the fossil fuel to HDS, and then to the instant biocatalytic desulfurization. Conversely, the specifications of the product(s) being generated may be best met by following biocatalytic desulfurization with a mild hydrotreating polishing step. This can ensure, for instance, that any aqueous traces (which are cosmetically undesirable, as residual water can produce cloudiness) are removed from the fuel product. In this manner it is possible to either treat the unfractionated fossil fuel at an early stage in the refining process, or to selectively treat only those fractions for which desulfurization is most problematic.

DETAILED DESCRIPTION OF THE INVENTION

This invention is based on the use of a unique biocatalytic agent which is capable of selectively liberating sulfur from the classes of organic sulfur molecules which are most refractory to known techniques of desulfurization, in conjunction with a known pre-combustion desulfurization technique. This combination provides for the synergistic deep desulfurization of the fossil fuel. A deeply desulfurized fossil fuel is one wherein the total residual sulfur content is at most about 0.05 wt %. Shih et al. When it is burned, a deeply desulfurized fossil fuel will not generate sufficient amounts of hazardous sulfur-containing combustion products to merit removal by a post-combustion desulfurization technique.

A preferred physicochemical desulfurization method for use in the instant combinative or multistage method is hydrodesulfurization, or HDS. HDS involves reacting the sulfur-containing fossil fuel with hydrogen gas in the presence of a catalyst, commonly a cobalt- or molybdenum-aluminum oxide or a combination thereof, under conditions of elevated temperature and pressure. HDS is more particularly described in Shih et al., Gary, J. H. and G. E. Handwerk, (1975) *Petroleum Refining: Technology and Economics*, Marcel Dekker, Inc., New York, pp. 114–120, and Speight, J. G., (1981) *The Desulfurization of Heavy Oils and Residue*, Marcel Dekker, Inc., New York, pp. 119–127. As noted previously, the aromatic sulfur-bearing heterocycles comprise the major class of organic sulfur molecules which are refractory to HDS treatment. Thus, HDS-treated petroleum fractions or fuel products generally have higher frequencies (relative to total remaining sulfur content) of these refractory heterocycles than the corresponding unfractionated crude oil. For example, two-thirds of the total residual sulfur in No. 2 fuel oil consists of sulfur-bearing heterocycles. Moreover, sulfur-bearing heterocycles occur in simple one-ring forms, or more complex multiple condensed-ring forms. The difficulty of desulfurization increases with the complexity of the molecule. Shih et al.

Figure 1:
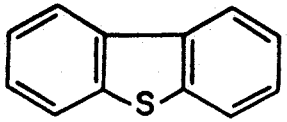
FIG. 1 illustrates the structural formula of dibenzothiophene, a model HDS-refractory sulfur-bearing heterocycle.

The tripartite condensed-ring sulfur-bearing heterocycle dibenzothiophene (DBT), shown in FIG. 1, is particularly refractory to HDS treatment, and therefore can constitute a major fraction of the residual post-HDS sulfur in fuel products. Alkyl-substituted DBT derivatives are even more refractory to HDS treatment, and cannot be removed even by repeated HDS processing under increasingly severe conditions. Shih et al. Moreover, DBTs can account for a significant percentage of the total organic sulfur in certain crude oils. They have been reported to account for as much as 70% of the total sulfur content of West Texas crude oil, and up to 40% of the total sulfur content of some Middle East crude oils. Therefore, DBT is viewed as a model refractory sulfur-bearing molecule in the development of new desulfurization methods. Monticello, D. J. and W. R. Finnerty, (1985) *Ann. Rev. Microbiol.* 39:371-389. No naturally occurring bacteria or other microbial organisms have yet been identified which are capable of effectively degrading or desulfurizing DBT. Thus, when released into the environment, DBT and related complex heterocycles tend to persist for long periods of time and are not significantly biodegraded. Gundlach, E. R. et al., (1983) *Science* 221:122-129.

Figure 2:
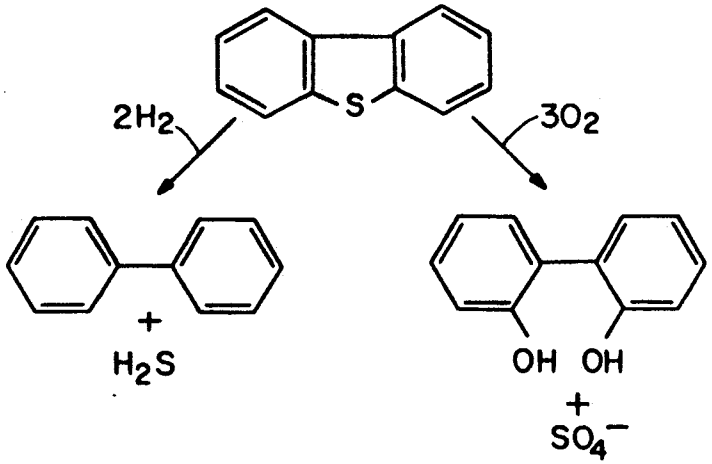
FIG. 2 is a schematic illustration of the cleavage of dibenzothiophene by oxidative and reductive pathways, and the end products thereof.

However, several investigators have reported the genetic modification of naturally-occurring bacteria into mutant strains capable of catabolizing DBT. Reviewed in Hartdegan, F. J. et al., (May 1984) *Chem. Eng. Progress* 63-67. For the most part, these mutants desulfurize DBT nonspecifically, and release sulfur in the form of small organic sulfur breakdown products. Thus, a portion of the fuel value of DBT is lost through this microbial action. Isbister and Doyle reported the derivation of a mutant strain of Pseudomonas which appeared to be capable of selectively liberating sulfur from DBT, but did not elucidate the mechanism responsible for this reactivity U.S. Pat. No. 4,562,156 (iss. Dec. 31, 1985). As shown in FIG. 2, there are at least two possible pathways which result in the specific release of sulfur from DBT: oxidative and reductive.

Figure 3:
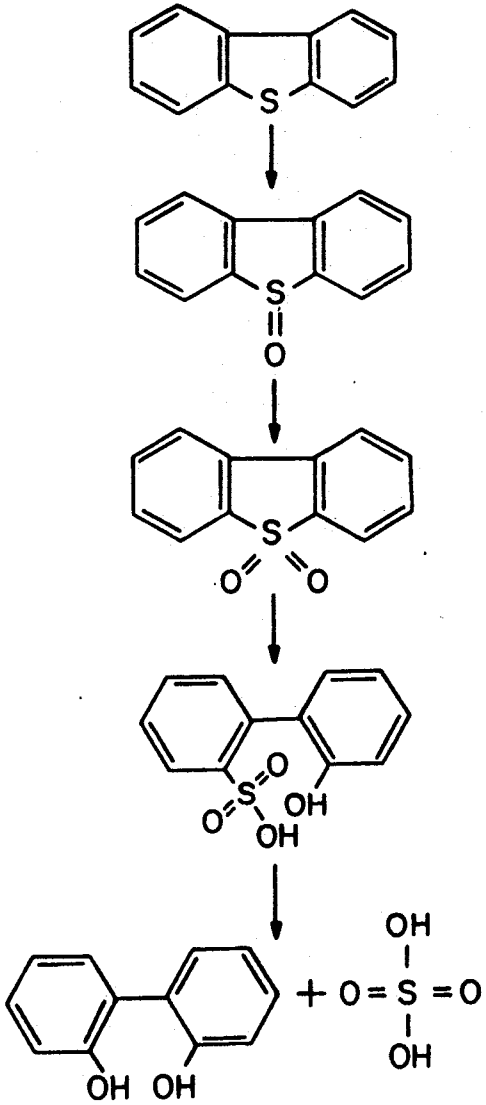
FIG. 3 is a schematic illustration of the stepwise oxidation of dibenzothiophene along the proposed "4S" pathway of microbial catabolism.

Kilbane recently reported the mutagenesis of a mixed bacterial culture, producing one which appeared capable of selectively liberating sulfur from DBT by the oxidative pathway. This culture was composed of bacteria obtained from natural sources such as sewage sludge, petroleum refinery wastewater, garden soil, coal tar-contaminated soil, etc., and maintained in culture under conditions of continuous sulfur deprivation in the presence of DBT. The culture was then exposed to the chemical mutagen 1-methyl-3-nitro-1-nitrosoguanidine. The major catabolic product of DBT metabolism by this mutant culture was hydroxybiphenyl; sulfur was released as inorganic water-soluble sulfate, and the hydrocarbon portion of the molecule remained essentially intact. Based upon these results, Kilbane proposed that the "4S" catabolic pathway summarized in FIG. 3 was the mechanism by which these products were generated. The designation "4S" refers to the reactive intermediates of the proposed pathway: sulfoxide, sulfone, sulfonate, and the liberated product sulfate. Kilbane, J. J., (1990) *Resour. Cons. Recycl.* 3:69-79.

Subsequently, Kilbane has isolated a mutant strain of *Rhodococcus rhodocrous* from this mixed bacterial culture. This mutant strain has been deposited at the American Type Culture Collection (ATCC), 12301 Park Lawn Drive, Rockville, Md., U.S.A. 20852 under the terms of the Budapest Treaty, and has been designated as ATCC Deposit No. 53968. It is a particularly preferred biocatalytic agent for use with the instant method of deep desulfurization. It is capable of divesting complex, condensed-ring heterocycles, such as DBT, of sulfur. It is therefore synergistic with HDS. The isolation of this mutant is described in detail in J. J. Kilbane, U.S. Pat. No. 5,104,801 (issued Apr. 14, 1992) the teachings of which are incorporated herein by reference.

In a preferred embodiment of the present invention, an aqueous culture of ATCC No. 53968 is prepared by conventional fermentation under aerobic conditions, such as may be accomplished using a bioreactor and a suitable nutrient medium, comprising a conventional carbon source such as dextrose or glycerol. In order to generate maximal biocatalytic activity, it is important that the bacteria be maintained in a state of sulfur deprivation. Optionally, this may be accomplished using a medium lacking a source of inorganic sulfate, but supplemented with DBT or a liquid petroleum sample with a high relative abundance of sulfur heterocycles. A finely divided slurry of coal particles can be used similarly.

When the culture has attained a sufficient volume and/or density, the fossil fuel to be desulfurized is contacted with it. The ratio of biocatalyst to the substrate fossil fuel in need of deep desulfurization can be varied widely, depending on the desired rate of reaction, and the levels and types of sulfur-bearing organic molecules present. Suitable ratios of biocatalyst to substrate can be ascertained by those skilled in the art through no more than routine experimentation. Preferably, the volume of biocatalyst will not exceed one-tenth the total incubation volume (i.e., 9/10 or more of the combined volume consists of substrate).

The combined biocatalyst and substrate fossil fuel are allowed to incubate under conditions suitable for biocatalytic action, for a sufficient period of time for the desired degree of deep desulfurization to occur. It will be noted that the proposed "4S" pathway requires that oxygen be supplied to the biocatalyst during the desulfurization incubation. The oxygen required can be supplied prior to or during the incubation, using conventional bubbling or sparging techniques. It is preferable to capitalize on the greater capacity of petroleum (compared to aqueous liquids) to carry dissolved oxygen by supplying the oxygen directly to the petroleum prior to contact with the biocatalyst. This can be accomplished by contacting the petroleum with a source of oxygen-enriched air, pure oxygen, or by supplementing the petroleum with an oxygen-saturated perfluorocarbon liquid.

The rate of desulfurization can optionally be enhanced by agitating or stirring the mixture of biocatalyst and substrate during the desulfurization incubation. The desulfurization rate can be further accelerated by conducting the incubation at a suitable temperature. Temperatures between about 10° C. and about 60° C. are suitable; ambient temperature is preferred. However, any temperature between the pour point of the petroleum liquid and the temperature at which the biocatalyst is inactivated can be used.

Several suitable techniques for monitoring the rate and extent of desulfurization, are well-known and readily available to those skilled in the art. Baseline and timecourse samples can be collected from the incubation mixture, and prepared for a determination of the residual organic sulfur in the substrate fossil fuel, normally by allowing the fuel to separate from the aqueous biocatalyst phase, or extracting the sample with water. The disappearance of sulfur from substrate hydrocarbons such as DBT can be monitored using a gas chromatograph coupled with mass spectrophotometric (GC/MS), nuclear magnetic resonance (GC/NMR), infrared spectrometric (GC/IR), or atomic emission spectrometric (GC/AES, or flame spectrometry) detection systems. Flame spectrometry is the preferred detection system, as it allows the operator to directly visualize the disappearance of sulfur atoms from combustible hydrocarbons by monitoring quantitative or relative decreases in flame spectral emissions at 392 nm, the wavelength characteristic of atomic sulfur. It is also possible to measure the decrease in total organic sulfur in the substrate fossil fuel, by subjecting the unchromatographed samples to flame spectrometry.

Figure 4A:
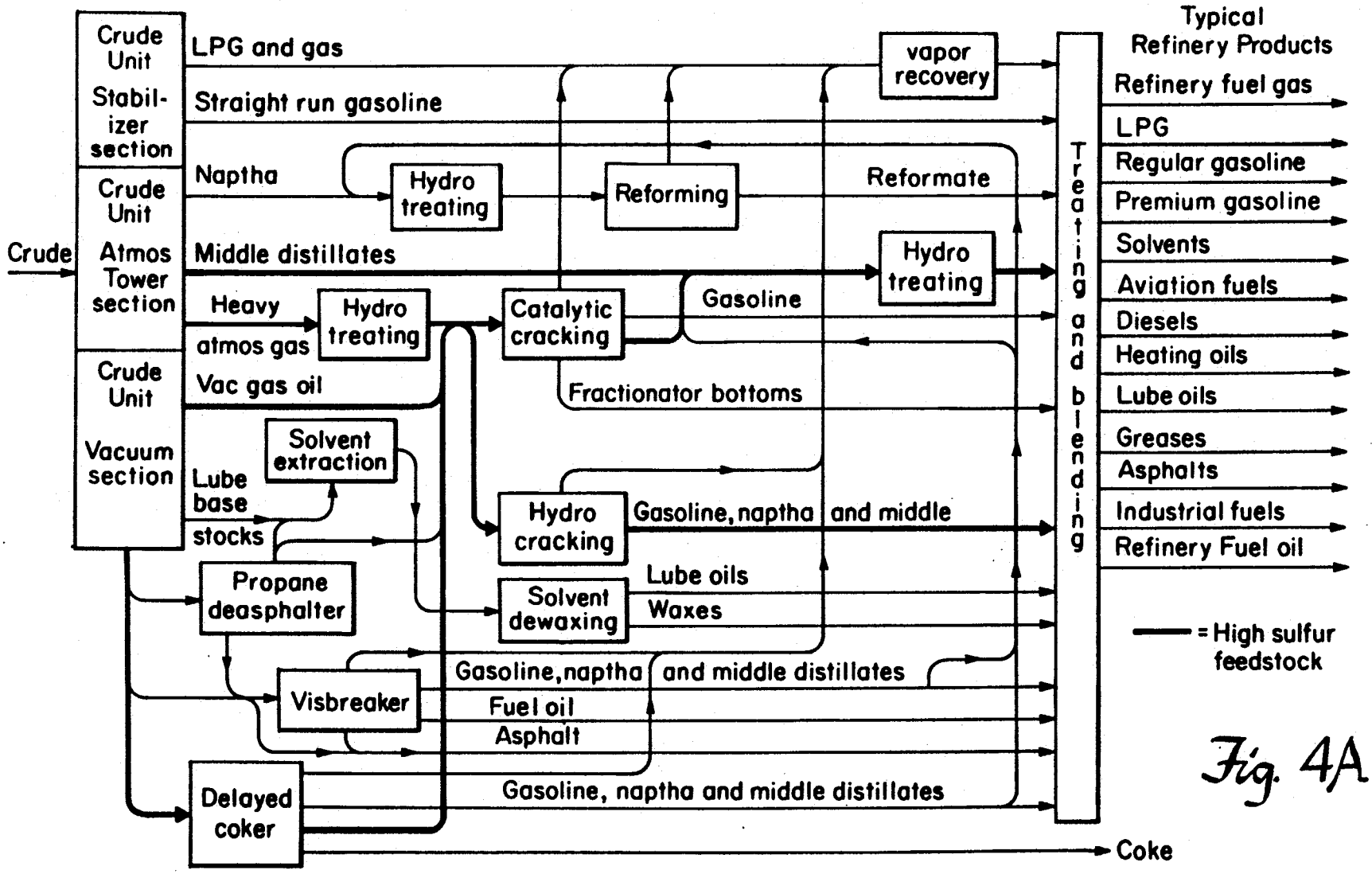
FIG. 4A is an overview of the processing of a typical crude oil sample through a conventional petroleum refining facility, in the form of a flow chart diagram; the routes taken by petroleum fractions containing HDS-refractory sulfur compounds shown as heavy dark lines.
Figure 4B:
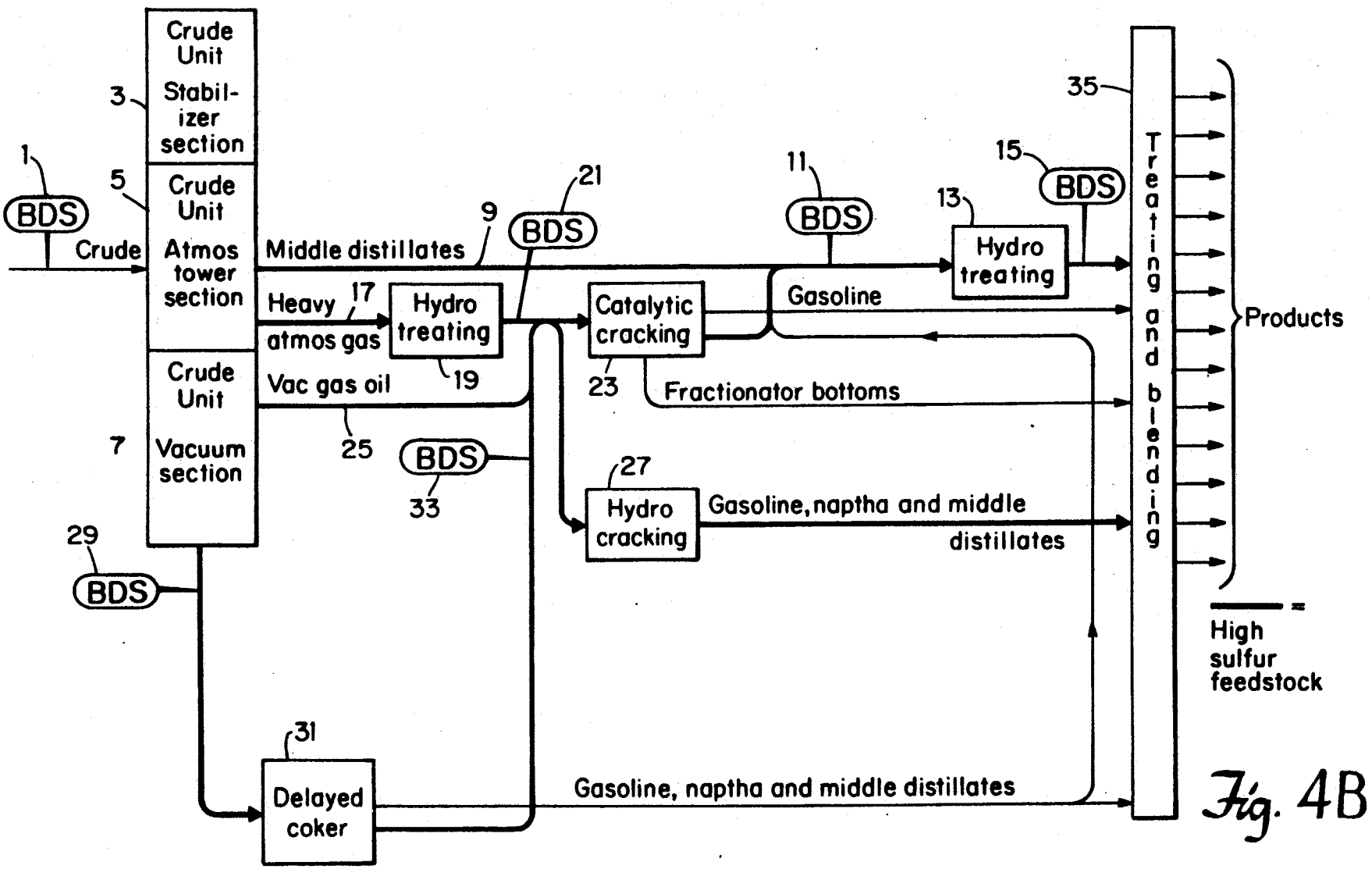
FIG. 4B is a flow chart diagram of relevant portions of the refining overview of FIG. 4A, showing several possible points at which the biocatalytic desulfurization (BDS) stage of the present invention can be advantageously implemented.

Depending on the nature of the particular facilities used, and the origin of the substrate fossil fuel, it may be more advantageous to use the ATCC No. 53968 biocatalyst either before or after HDS. This point is illustrated in FIG. 4. FIG. 4A provides an overview of current practices for the refining of a typical crude oil, and a selection of the products which may be produced in a typical facility. The routes of petroleum fractions enriched in total sulfur content or in HDS-refractory sulfur content are shown as heavy dark lines. FIG. 4B focusses on portions of the refining process which are relevant to the instant multistage deep desulfurization system. In particular, several points along the routes taken by the high-visualize sulfur petroleum fractions are shown at which a processing unit suitable for biocatalytic desulfurization (BDS) of HDS-refractory sulfur compounds can be advantageously implemented.

The raw or unrefined liquid can be subjected to BDS at its point of entry into the refining facility 1, prior to passage through the crude unit stabilizer 3, crude unit atmospheric distiller 5, and crude unit vaccuum distiller 7. Typically, the atmospheric middle distillate fractions 9 contain HDS-refractory sulfur compounds, which can advantageously be biocatalytically desulfurized either prior to (ii), or following (15), a mild hydrotreating (HDS) polishing step 13. The treated petroleum fractions are then subjected to a final treating and blending step 35 where they are formulated into products such as regular or premium gasoline, or diesel fuel.

The heavy atmospheric gas 17 (i.e., the remaining liquid from the atmospheric distillation) also contains HDS-refractory sulfur compounds, and is normally subjected to a hydrotreating step 19. This can advantageously be followed by a BDS step 21 prior to either catalytic cracking 23 or hydrocracking 27, in which high molecular weight hydrocarbons are converted into smaller molecules more appropriate for fuel formulations. The products of the cracking step can also optionally be subjected to BDS before or after (11 or 15) additional hydrotreating 13. If the cracked hydrocarbons need no further desulfurization, they are subjected to the final treating and blending step 35, where they are formulated into products such as regular or premium gasoline, diesel fuel or home heating oil.

The products of the crude unit vaccuum distillation 7 are typically enriched for sulfur compounds, especially high molecular weight HDS-refractory sulfur compounds. The vaccuum gas oil 25 is processed in essentially the same manner as the heavy atmospheric gas 17: it can optionally be subjected to BDS at 21, prior to either catalytic cracking 23 or hydrocracking 27. If desired, the products of the cracking step can be subjected to BDS before or after (11 or 15) additional hydrotreating 13. Alternatively, the products can be routed to the final treating and blending step 35, where they are formulated into products such as regular or premium gasoline, diesel fuel, home heating oil, or various greases.

The residue remaining after the crude unit vaccuum distillation 7 is typically quite high in sulfur content, which can advantageously be decreased by BDS at 29. The residue is next introduced into a delayed coker unit 31, which, if desired, can be followed by BDS at 33. The residue can then be treated as for the vaccuum gas oil, i.e., subjected to either catalytic cracking 23 or hydrocracking 27. The cracked hydrocarbons can optionally be subjected to BDS prior to or following (11 or 15) an additional hydrotreating step 13, or can proceed directly to the final treating and blending step 35, for formulation into products such as regular or premium gasoline, diesel fuel, home heating oil, various greases, or ashphalt.

As noted previously, there are inherent advantages to positioning biocatalytic desulfurization at each of the above-listed positions in the refining process. Implementation of an early stage (e.g., 1) BDS is advantageous because the crude oil arrives at the refinery already "contaminated" with some aqueous liquid. Procedures for removing this aqueous phase during refining are well known and commonly employed; thus, any additional aqueous contamination from biocatalytic treatment would be incidental and readily removed. Moreover, as the value of unrefined crude oil considerably lower than its refined and formulated products, and as the raw commodity can economically be purchased in advance and stored on-site, an extended biocatalytic deep desulfurization incubation is feasible and would facilitate downstream production of valuable fuel products. However, the large scale and low relative abundance of HDS-refractory sulfur-bearing heterocycles in the substrate at the beginning of the refining process may prove detrimental to sucessfull biocatalytic desulfurization this stage. Further, a significant safety factor must be taken into account: oxygenation of unfractionated crude oil may produce an explosive mixture, depending on the types and relative abundance of low molecular weight flammable components in the raw fossil fuel.

It is generally more advantageous to subject petroleum fractions enriched in HDS-refractory sulfur compounds, or depleted of HDS-labile sulfur compounds, to the biocatalysis stage of the instant invention. In this manner, the fractions subjected to BDS will have smaller volumes but be concurrently enriched in total or HDS-refractory sulfur content. Biocatalytic desulfurization may be advantageously implemented at positions such as 11, 15, 21, 29, or 33. In making the decision where best to deploy a BDS unit, certain aspects of the hydrodesulfurization stage of the present invention must be considered. In particular, it must be borne in mind that although inadequate to achieve deep desulfurization by itself, hydrodesulfurization remains a beneficial and, in many instances, necessary refining step. The conditions encountered in HDS are sufficient not only to remove sulfur from labile organic sulfur-containing compounds, but also to remove excess oxygen and nitrogen from organic compounds, and to induce saturation of at least some carbon-carbon double bonds, thereby increasing the fuel value of the treated petroleum fraction. In this broader context, the process is commonly referred to as hydrotreating rather than HDS. Gary, J. H. and G. E. Handwerk, (1975) *Petroleum Refining: Technology and Economics*, Marcel Dekker, Inc., New York, pp. 114–120. The cosmetic quality of the product is improved, as many substances having an unpleasant smell or color are removed. Hydrotreating also clarifies the product, by "drying" it or depleting it of residual water, which produces a cloudy appearance. Several commercial petroleum products, such as gasoline or diesel fuel, must meet fairly stringent specifications; hydrotreating is one commonly used method to ensure that these products comply with applicable standards. Thus, biocatalytic desulfurization of a suitable petroleum fraction can frequently be followed by a hydrotreating polishing step, as at 11, 21, or 13.

Although hydrotreating or HDS can be advantageous to the production of specific fuel products, severe HDS conditions are to be avoided, since they have been reported to be actively detrimental to the integrity of the desired products. For example, Shih et al. caution that exposure of petroleum refining fractions to typical HDS conditions at temperatures in excess of about 680° F. decreases the fuel value of the treated product. Shih et al. further report that in order to achieve deep desulfurization solely through the use of HDS, petroleum refining fractions which contain significant amounts of refractory sulfur-bearing heterocycles must be exposed to temperatures in excess of this threshold. For example, FCC light cycle oil must be subjected to HDS at temperatures as high as 775° F. if deep desulfurization is to be attempted using conventional techniques. Therefore, petroleum refining fractions enriched in HDS-refractory aromatic heterocycles cannot be efficaciously converted into desirable low-sulfur products, such as gasoline or diesel fuel, using current desulfurization technology. Thus, one particular advantage of the present invention is that it significantly expands the types of refining fractions which can be used to produce desirable low-sulfur fossil fuel products.

In addition, the attempted HDS-desulfurization of refractory organic sulfur compounds, or even of a fraction highly enriched in labile organic sulfur compounds, requires a substantial input of $H_2$ gas. This is an expensive commodity; typically, any excess $H_2$ gas is trapped and recycled. However, it is frequently necessary for a refining facility to construct a hydrogen-generation unit and integrate it into the refining process. Speight, J. G. (1981), *The Desulfurization of Heavy Oils and Residue,* Marcel Dekker, Inc., New York, pp. 119–127. This is a capital-intensive undertaking, making it a desirable refining step to avoid.

Moreover, exposure of the chemical catalysts used for HDS to excessive concentrations of $H_2S$, the gaseous inorganic sulfur product formed as a result of HDS, is known to poison the catalyst, thus prematurely shortening the duration of its utility. Extended HDS treatment of complex organic sulfur compounds, especially refractory compounds, at elevated temperatures is also known to produce the deposition of carbonaceous coke on the catalyst. These factors contribute materially to the premature inactivation of the chemical HDS catalyst.

The foregoing considerations demonstrate that a significant advantage of the instant multistage system for deep desulfurization of fossil fuels is that it allows the use of milder HDS conditions than would otherwise be required, by providing for biocatalytic removal of the sulfur-containing compounds, such as DBT and its alkylated derivatives, which require harsh or difficult-to-maintain conditions such as excessive temperature or $H_2$ input. Mild hydrotreating, such as at 13 or 19 can be either preceeded (e.g., 11) or followed (e.g., 15, 21) by biocatalytic desulfurization to remove refractory compounds. In this manner, desirable fuel products are manufactured at lower capital cost without exposure of either the petroleum fraction or the refining equipment and components to potentially dangerous or deleterious conditions, even from refining fractions which previously were not considered to be available for the manufacture of deeply desulfurized fuel products.

In other preferred embodiments of the present method, an enzyme or array of enzymes sufficient to direct the selective cleavage of carbon-sulfur bonds can be employed as the biocatalyst. Preferably, the enzyme(s) responsible for the "4S" pathway can be used. Most preferably, the enzyme(s) can be obtained from ATCC No. 53968 or a derivative thereof. This enzyme biocatalyst can optionally be used in carrier-bound form. Suitable carriers include killed "4S" bacteria, active fractions of "4S" bacteria (e.g., membranes), insoluble resins, or ceramic, glass, or latex particles. One advantage of an enzymatic biocatalyst over a living bacterial biocatalyst is that it need not prepared in an aqueous liquid: it can be freeze-dried, then reconstituted in a suitable organic liquid, such as an oxygen-saturated perfluorocarbon. In this manner, biocatalytic deep desulfurization can be conducted without forming a two-phase (i.e., organic and aqueous) incubation mixture.

It is also possible to conduct the present multistage deep desulfurization method using entirely microbial biocatalytic agents. In this embodiment, the first microbial biocatalyst is one which shares substrate specificity with a physicochemical desulfurization method, such as HDS: it is important that agents which are specific for complementary classes of sulfur-containing molecules be used in all embodiments. One suitable MDS process for use with coal slurries is taught by Madgavkar, A. M. (1989) U.S. Pat. No. 4,861,723, which involves the use, preferably, of a Thiobacillus species as the biocatalyst. Another MDS process, more suited to use with liquid petroleum, is taught by Kirshenbaum, I., (1961) U.S. Pat. No. 2,975,103; this process relies on the use of naturally-occurring bacteria such as *Thiophyso volutans, thiobacillus thiooxidans,* or *thiobacillus thioparus.* It is also possible that mutually suitable conditions for a mixed or concurrent microbial deep desulfurization method can be developed. Alternatively, the genes encoding enzymes responsible for either the "4S" metabolic activity, or the conventional desulfurization activity, can be isolated and placed in an expression vector. This expression vector can subsequently be introduced into a new bacterial host. Optionally, the genes responsible for both activities can be introduced into the same bacterial host. Suitable techniques for cloning these genes and constructing an engineered bacterial host are well known in the art, and are described in Maniatis, T., et al., (1989) *Molecular Cloning: a Laboratory Manual,* 2d ed., Cold Spring Harbor Laboratory Press, and *Current Protocols in Molecular Biology,* Ausubel, F. M., et al., eds., Sarah Greene, pub., New York (1990).

Once the fossil fuel has been sufficiently incubated with the biocatalytic agent capable of liberating sulfur from refractory molecules, it is separated from the agent and any water-soluble inorganic sulfur which has been generated during the deep desulfurization incubation. In most embodiments, separation is achieved by allowing the fossil fuel (the organic phase) and the biocatalyst (the aqueous phase) to settle or separate. The deeply desulfurized fossil fuel is then decanted, and the aqueous biocatalyst is recovered and discarded or optionally reused. In embodiments wherein a nonaqueous biocatalyst is used, the incubation mixture is extracted with a sufficient volume of water to dissolve any water-soluble inorganic sulfur which has been generated during the desulfurization incubation, and decanted therefrom. The resulting deeply desulfurized fossil fuel can be burned without the concommittant formation of sufficient amounts of hazardous sulfur-containing combustion products to merit use of a flue scrubber or similar post-combustion desulfurization apparatus.

The invention will now be further illustrated by the following examples, which are not to be viewed as limiting in any way.

EXAMPLE 1

A petroleum distillate fraction, similar in specific gravity and other properties to a typical middle distillate (9 in FIG. 4B) or a heavy atmospheric gas oil (17) or a vacuum gas oil (25) or the material from a delayed coker, having an initial sulfur content of 0.51 wt %, was treated with a preparation of *Rhodococcus rhodochrous* ATCC No. 53968. The biocatalyst preparation consisted of an inoculum of the bacteria in a basal salts medium, comprising:

TABLE 1

| Component | Concentration |
|---|---|
| $Na_2HPO_4$ | 0.557% |
| $KH_2PO_4$ | 0.244% |
| $NH_4Cl$ | 0.2% |
| $MgCl_2.6H_2O$ | 0.02% |
| $MnCl_2.4H_2O$ | 0.0004% |
| $FeCl_3.6H_2O$ | 0.0001% |
| $CaCl_2$ | 0.0001% |
| glycerol | 10 $\mu$M |

The bacterial culture and the substrate petroleum distillate fraction were combined in the ratio of 50:1 (i.e., a final concentration of 2% substrate). The BDS stage of the instant deep desulfurization was conducted in shake flasks with gentle agitation at ambient temperature for 7 days. Subsequent analysis of the distillate fraction revealed that the wt % sulfur had fallen to 0.20%, representing a 61% desulfurization of the substrate petroleum liquid. Characterization of the sample before and after BDS treatment by gas chromotography coupled to a sulfur-specific detector demonstrated that prior to treatment, the sample contained a broad spectrum of sulfur-bearing organic molecules. Due to the action of the ATCC No. 53968 biocatalyst, the levels of a broad variety of these molecules were reduced in the post-BDS sample, including DBTs and alkylated DBT derivatives. These results are in contrast with those reported in connection with a similar analysis of petroleum refining samples subjected to HDS treatment; see Shih et al.

EXAMPLE 2

A light distillate (No. 1 diesel, a fraction which would typically be obtained by mild hydrotreating, e.g., at 13 in FIG. 4B), initially containing 0.12% sulfur, was treated with the ATCC No. 53968 biocatalyst as described in Example 1. The sulfur compounds in this sample were mainly benzothiophenes and dibenzothiophenes, as would be expected from a sample subjected to HDS treatment under moderate conditions. Treatment with the instant biocatalyst reduced the residual sulfur level in the substrate to 0.04 wt %. These results demonstrate that samples naturally high in DBT-like molecules, or artificially high due to prior HDS treatment, can be deeply desulfurized using the multistage system of the present invention.

EQUIVALENTS

Those skilled in the art will recognize, or be able to ascertain using no more than routine experimentation, many equivalents to the specific embodiments of the invention described herein. These and all other such equivalents are intended to be encompassed by the following claims.

I claim:

1. A method for the deep desulfurization of a liquid fossil fuel, comprising the steps of:

(a) subjecting the liquid fossil fuel to hydrodesulfurization (HDS) whereby the liquid fossil fuel is depleted of forms of sulfur susceptible to removal by HDS but is not depleted of forms of sulfur refractory to HDS;

(b) contacting the liquid fossil fuel with an effective amount of a biocatalyst comprising one or more microorganisms capable of converting HDS-refractory organic sulfur into water-soluble inorganic sulfur;

(c) incubating the liquid fossil fuel with said biocatalyst under conditions sufficient for the conversion of a substantial amount of the HDS-refractory organic sulfur into water-soluble inorganic sulfur; and (d) separating the products of the incubation of step (c), the products including:

(i) deeply desulfurized liquid fossil fuel, and (ii) water-soluble inorganic sulfur.

2. A method of claim 1 wherein the biocatalyst comprises a culture of *Rhodococcus rhodocrous* bacteria, ATCC No. 53968.

3. A method of claim 2 wherein the incubation conditions of step (c) include aerobic conditions.

4. A method of claim 3 including the additional step of contacting the liquid fossil fuel with a source of oxygen prior to the incubation of step (c), whereby oxygen tension in the liquid fossil fuel is substantially increased.

5. A method for the deep desulfurization of a liquid fossil fuel, comprising the steps of:

(a) subjecting the liquid fossil fuel to hydrodesulfurization (HDS) whereby the liquid fossil fuel is depleted of forms of sulfur susceptible to removal by HDS but is not depleted of forms of sulfur refractory to HDS;

(b) contacting the liquid fossil fuel with an effective amount of a biocatalytic agent comprising *Rhodococcus rhodocrous bacteria, ATCC No.* 53968;

(c) incubating the liquid fossil fuel with the biocatalytic agent under aerobic conditions sufficient for a substantial number of oxidative cleavages of organic carbon-sulfur bonds to occur; and (d) separating the products of the incubation of step (c), the products including:

(i) deeply desulfurized liquid fossil fuel, and (ii) water-soluble inorganic sulfur.

6. A method of claim 5 including the additional step of contacting the liquid fossil fuel with a source of oxygen prior to the incubation of step (c), whereby the oxygen tension in the liquid fossil fuel is substantially increased.

7. A method of producing a liquid fossil fuel which, when burned, generates reduced levels of sulfur-containing combustion products, comprising the steps of:

(a) subjecting a liquid fossil fuel to hydrodesulfurization (HDS), whereby it is depleted of forms of sulfur susceptible to removal by HDS but is not depleted of HDS-refractory organic sulfur-bearing heterocycles;

(b) contacting the HDS-treated liquid fossil fuel with an effective amount of a biocatalytic agent comprising one or more bacterial strains capable of converting HDS-refractory organic sulfur in heterocycles into water-soluble inorganic sulfur;

(c) incubating the liquid fossil fuel with the biocatalytic agent under aerobic conditions sufficient for the conversion of a substantial amount of the HDS-refractory organic sulfur into water-soluble inorganic sulfur;

(d) separating the products of the incubation of step (c), the products including:

(i) a deeply-desulfurized liquid fossil fuel, and (ii) water-soluble inorganic sulfur.

8. A method of claim 7 including the additional step of contacting the liquid fossil fuel with a source of oxygen prior to the incubation of step (c), whereby the oxygen tension in the liquid fossil fuel is substantially increased.

9. A method of producing a deeply desulfurized liquid fossil fuel for combustion, said fuel having a total residual sulfur content of below about 0.05 wt %, comprising the steps of:

(a) subjecting a liquid fossil fuel containing organic sulfur, including aromatic sulfur-bearing heterocycles, to hydrodesulfurization (HDS), whereby said fuel is depleted of forms of organic sulfur susceptible to removal by HDS but is not depleted of sulfur-bearing aromatic heterocycles;

(b) contacting the HDS-treated liquid fossil fuel with an effective amount of a biocatalytic agent comprising one or more microorganisms such that water-soluble inorganic sulfur is produced therefrom;

(c) incubating the HDS-treated liquid fossil fuel with the biocatalytic agent under aerobic conditions sufficient for a substantial number of cleavages of organic carbon-sulfur bonds in said heterocycles to occur, the combination of HDS and biocatalytic treatment being such that a liquid fossil fuel having a total residual sulfur content of below about 0.05 wt % is obtained, and (d) separating the products of the incubation of step (c), the products including:

(i) a deeply-desulfurized liquid fossil fuel, and (ii) water-soluble inorganic sulfur.

* * * * *